United States Patent [19]

Kuno

[11] Patent Number: 4,972,751

[45] Date of Patent: Nov. 27, 1990

[54] ROTARY VALVES FOR BRASS WIND INSTRUMENTS

[75] Inventor: Hiroaki Kuno, Tokai, Japan

[73] Assignee: Inax Corporation, Aichi, Japan

[21] Appl. No.: 467,508

[22] Filed: Jan. 19, 1990

Related U.S. Application Data

[63] Continuation-in-part of Ser. No. 448,325, Dec. 11, 1989.

[30] Foreign Application Priority Data

Mar. 27, 1989 [JP] Japan ..... 1-74574

[51] Int. Cl.[5] ..... G10D 9/04

[52] U.S. Cl. ..... 84/390; 84/452 P

[58] Field of Search ..... 84/390, 452, 452 P, 84/387, 388; 428/307.3

[56] References Cited

U.S. PATENT DOCUMENTS 4,095,504 6/1978 Hirsbrunner ..... 84/390

4,892,786 1/1990 Newkirk ..... 428/307.3

*Primary Examiner*—Brian W. Brown

*Attorney, Agent, or Firm*—Christopher John Rudy

[57] ABSTRACT

A rotary valve for brass wind instruments with improved lubricating and durability properties is provided. The valve body 2 or both the valve body 2 and casing 1 of the rotary valve comprise(s) a machinable ceramic-resin composite material. The rotary valve can be readily produced by a method which comprises impregnating a machinable ceramic article containing substantially continuous micropores with a liquid resin material and hardening the resin material; machine-processing the resulting machinable ceramic-resin composite article into a shape of the valve body or shapes of the valve body and casing; and assembling the valve body into a rotary valve having the valve body 2 of the composite material rotatably contained in the casing 1 of the composite material or a metal material.

20 Claims, 3 Drawing Sheets

ROTARY VALVES FOR BRASS WIND INSTRUMENTS

CROSS REFERENCE TO RELATED APPLICATION

This, is a continuation in-part application of U.S. application Ser. No. 07/448,325, entitled "MUSICAL INSTRUMENTS COMPRISING CERAMIC-RESIN COMPOSITES", filed Dec. 11, 1989.

BACKGROUND OF THE INVENTION

1. Field of the Invention

This invention relates to novel rotary valves comprising ceramic-resin composites for brass wind musical instruments.

2. Prior Art

Conventional rotary valves for the instruments have been made of a metal material such as brass. The schematic constructions of a rotary valve for brass winds are explained with reference to FIG. 3. Numeral 1 represents a casinq composed of a slightly tapering cylinder like portion 1' and terminal plates 7, 8, into which a valve body 2 is rotatably inserted. The valve body 2 is nearly columnar, and two round grooves 3, 4 extending in the direction orthogonal to the axis of the column body are bored on the opposite sides through the outer regions of the valve body 2. Valve axes 5, 6 protrude from the centers of the both end surfaces of the valve body 2. The cylinder portion 1' of the casing 1 is provided with terminal plates 7, 8 at the both ends thereof. The valve body 2 is supported by inserting the valve axes 5 and 6 into the bearings 9 and 10 which are provided at the centers of the terminal plates 7 and 8, respectively.

In the casing 1, plural (normally four) openings 11 of round shapes are provided for the flow of air. By rotating the valve body 2 to a predetermined rotation phase and then holding the valve body there, certain openings 11 are communicated to adjust the length of sound waves. Incidentally, the valve axis 5 is connected Lo a cam rod (not shown in FIG. 3). When a player of the brass wind pushes a button on the wind instrument, the valve body 2 is rotated by means of the cam rod to a predetermined position and held at the position. A plurality of such rotary valves are provided in the cylindrical tubes of the brass wind, and thus the brass wind is constructed such that the paths of air flow can be changed in multiple ways.

More specifically, the openings 11*a* and 11*b* in FIG. 3 are connected to the cylindrical tubes of a brass wind instrument, respectively. The openings 11*a* and 11*b* communicate with the groove 4 of the valve body 2, for example, in the normal position of the valve body, and air flows from the opening 11*a* to the opening 11*b* via the groove 4. The openings 11*c* and 11*d* are connected with a cylindrical tube (not shown in FIG. 3). When a button is pushed by a player, the valve body turns by 90 degrees, and connects the opening 11*a* to the opening 11*c* via the groove 4 and the opening 11*d* to the opening 11*b* via the groove 3 of the valve body. Thus, air flows through the path composed of the opening 11*a*, groove 4, opening 11*c*, cylindrical tube, opening 11*d*, groove 3 and opening 11*b*, whereby certain lowpitched tones are produced. Such constructions and mechanisms of the rotary valves do not make a large difference between the conventional brass valve and the valve of the present invention.

Since the valve bodies and casings in conventional rotary valves have been made of brass, the valve axes and holes of bearings are apt to wear into looseness in a short period of use. Moreover, rust is often produced between the valve body and casing, which impairs smooth rotation of the valve body. In addition, a brass valve body can rotate smoothly by slightly oiling the valve with a lubricating oil and by the lubricating action of the water produced on outer surfaces of the valve body through dew condensation of the moisture contained in the breath of an instrument player. Thus, the valve body sometimes fails to rotate smoothly when humidity in air is so low or temperature is so warm that the dew condensation does not take place.

SUMMARY OF THE INVENTION

The main object of the present invention is to provide a rotary valve for brass wind instruments comprising a machinable ceramic-resin composite material, wherein the above-mentioned problems are substantially eliminated because the ceramic-resin composite is hard and light and the resin material contained in the composite unexpectedly exhibits good lubricating action. Other objects and features of the invention will become apparent from the following description.

According to the invention, there is provided a rotary valve for a brass wind instrument which comprises a valve body rotatably contained in a casing therefor, characterized in that the valve body comprises a machinable ceramic-resin composite material and the casing comprises a machinable ceramic-resin composite material or a metal material, the machinable ceramic containing substantially continuous micropores and being impregnated with a resin material, the resin material being hardened, and the composite material being machine-processed.

It is generally preferred in view of performances and durability that both the valve body and casing comprise the ceramic-resin composite.

The rotary valve can comprise valve axes of a hard ceramic (e.g. harder than the machinable ceramic) or anti-corrosive metal which are connected to the valve body and are supported by the bearings of a hard ceramic or anti-corrosive hard metal attached to the casing. The outer surface of the rotary valve can be substantially covered with a metal case which is readily brazed or soldered.

The rotary valve according to the invention can be produced by a method which comprises:

impregnating a machinable ceramic article containing substantially continuous micropores with a liquid resin material and hardening the resin material, machine-processing the resulting machinabe ceramic-resin composite article into a shape of the valve body or shapes of the valve body and casing, and assembling the valve body into a rotary valve having the valve body rotatably contained in the casing.

The rotary valve according to the invention is intended for use in brass wind instruments including, for example, horn, tuba, trumpet, tenor bass, trombone, bass trombone, etc.

DESCRIPTION OF THE PREFERRED EMBODIMENTS

The machinable ceramics used in the present invention need to have substantially continuous micropores, so that the ceramics can be effectively impregnated with resin materials. The amount of the micropores in the ceramics, expressed by water absorption capacity (the weight increase of a ceramic owing to absorbed water when the ceramic is soaked in water for about 24 hours), is usually about 3 to 40% by weight and preferably about 5 to 25% by weight. The diameter of the micropores is desired to be considerably small in view of strength and homogeneity. The average diameter thereof is usually not more than 100 microns, preferably not more than 10 microns, more preferably not more than 5 microns, and typically about 5 to 0.1 micron.

The term "machinable ceramic" means ceramics which can be readily subjected to machine processing such as cutting, boring, drilling and grinding without cutting fractures such as chipping, cracking or breaking. The machinability of the ceramics can be defined by the cutting speed thereof by means of a lathe with a tungsten carbide (WC) bit [a bit moving speed of 0.097 mm/rotation, a bit-notch depth of 2~4 mm]. The machinable ceramics used in the present invention have a peripheral cutting speed of not lower than 30 m/min., preferably not lower than 50 m/min. and more preferably not lower than 70 m/minute under the above-mentioned cutting conditions. Incidentally, the ceramic material used in the working examples given below had a machinability (cutting speed) of more than 70 meters/-minute without cutting fracture.

The machinable ceramics used in the invention can be produced from a raw material mixture comprising, for example, 20 to 50 parts of CaO, 45 to 70 parts of $SiO_2$ and 0.1 to 25 parts of MgO on a weight basis by molding the mixture and then sintering the resulting molded article at a maximum temperature of not lower than 1000° C. and generally not higher than 1400° C., preferably not lower than 1100° C., more preferablly not lower than 1150° C., and typically 1200° to 1350° C. The raw material can comprise the above-mentioned $CaO/SiO_2/MgO$ components, based on the total weight of the raw material, in an amount of not less than 60%, preferably not less than 70% and more preferably not less than 80%; and the raw material can contain not more than 20% of other alkali/alkaline-earth metal oxide components and not more than 20% of other sintering mineral components based on the total weight of the raw material.

Figure 4:
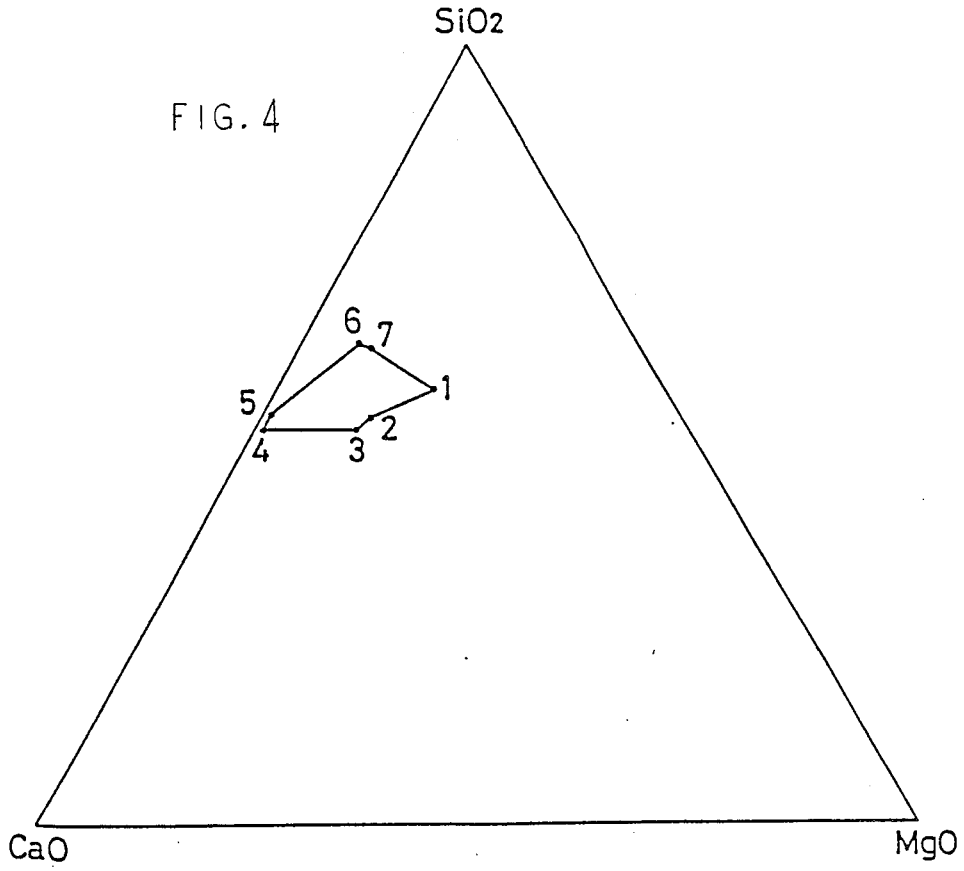
FIG. 4 shows a $CaO-SiO_2-MgO$ three-component triaxial diagram of the machinable ceramic.

The sintered ceramics used as a basic material of the rotary valve are preferably those having a composition of CaO, $SiO_2$ and MgO which is defined by the region or area surrounded by points 1, 2, 3, 4, 5, 6 and 7 in FIG. 4. Each of the points 1~7 in FIG. 4 corresponds to the compositions shown in the following table.

| | (% by weight) | | |
|---|---|---|---|
| Point | CaO | $SiO_2$ | MgO |
| 1 | 25.7 | 55.5 | 18.8 |
| 2 | 35.4 | 51.6 | 13.0 |
| 3 | 36.5 | 51.3 | 12.2 |

-continued

| | (% by weight) | | |
|---|---|---|---|
| Point | CaO | $SiO_2$ | MgO |
| 4 | 47.4 | 51.6 | 1.0 |
| 5 | 45.9 | 53.1 | 1.0 |
| 6 | 31.2 | 61.7 | 7.1 |
| 7 | 30.2 | 61.5 | 8.3 |

Such sintered ceramics are obtained, for example, by blending CaO, $SiO_2$ and MgO in such a ratio that the resulting composition may fall within a range of the area surrounded by the points 1, 2, 3, 4, 5, 6 and 7 in FIG. 4, molding the mixture and then firing the resulting molded article, for example, at a temperature higher than 1200° C. and not higher than 1350° C. As a raw material of the CaO and $SiO_2$ can be used natural or synthetic $\beta CaO \bullet SiO_2$ such as wollastonite and xonotlite. As the MgO material can be used talc, dolomite, magnesium hydroxide, magnesium carbonate and magnesium oxide. These raw materials are well milled and blended in such a degree that the needle-like or platlete-like crystals are not destroyed, adjusted with respect to water content, shaped in a mold to give a molded article having outer configurations larger than the valve body and casing, and then fired.

The above mentioned sintered ceramics containing $CaO-MgO-SiO_2$ component systems are very good in cut-machinability. Namely, the $\beta$-wollastonite ($\beta CaO \bullet SiO_2$) contained in the raw material is aggregated crystals of triclinic system which have grown in the form of platelets and has an excellent cut-machinability. However, upon firing the $\beta CaO \bullet SiO_2$ at 1200° C. or higher, monoclinic $\alpha$-wollastonite is crystallized out of the $\beta CaO \bullet SiO_2$, which results in imparing the cut-machinability thereof. MgO is added to the $\beta$-wollastonite in order to raise the transition temperature of the $\beta$-wollastonite to $\alpha$-wollastonite. Thus, the resulting mixture can be fired at the high temperature to obtain good machinability of the $\beta$-wollastonite and high mechanical strength. Incidentally, if the amount of M90 is too much, the resulting sintered ceramic becomes too hard and is decreased in the cut-machinability thereof. Thus, sintered ceramics having a composition within a region surrounded by points 1~7 in FIG. 4 are preferred. It is also possible to use sintered ceramics of $CaO \bullet SiO_2$ component systems sintered at a lower temperature, although the strength of the ceramics is decreased.

The sintered ceramic article which has been formed upon firing into a predetermined shape is degassed in a vacuum apparatus. The degassed sintered ceramic article can be satisfactorily impregnated with a resin by soaking the article in a liquid resin (preferably with pressurization of the liquid resin). The impregnated liquid resin is then hardened by heating or the like.

As the resin can be used, for example, acrylic resins [e.g. polymethyl methacrylate (PMMA)], epoxy resins, saturated or unsaturated polyester resins, silicone resins, and mixtures thereof.

By impregnating the sintered ceramic article with a resin as described above, voids formed in the sintered article are substantially filled with the resin to lose water absorption property and air permeability from the sintered ceramic article, whereby bending strength thereof is increased and non-vibration property thereof is much enhanced.

After impregnation with a resin as mentioned above, the ceramic article can be processed into parts having predetermined shapes by optionally utilizing working machines such as lathes and boring machines. Since the sintered ceramic article is excellent in cut-machinability, it can be subjected to processing such as drilling, grooving, etc. without generating cracks, chipping or the like to give a finished product having very high surface precision with respect to the outer surfaces of the valve body and the inner surfaces of the casing.

The present invention is further explained in detail below with reference to the drawings.

Figure 1:
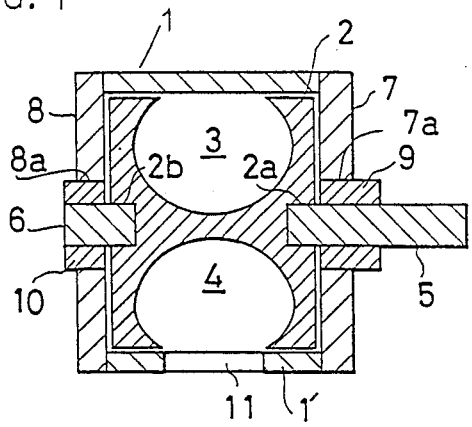
FIGS. 1 and 2 show sectional views of the rotary valves according to the working examples hereinafter described.

FIG. 1 is a longitudinal sectional view of a rotary valve of a brass wind according to an embodiment of the present invention. In the embodiment, the casing 1 including terminal plates 7, 8 (about 1~4 mm in thickness) and the valve body 2 are made from a machinable ceramic impregnated with a resin. At the centers of the terminal plates 7 and 8 are bored openings 7*a* and 8*a*, respectively, and bearings 9 and 10 made from a hard ceramic such as alumina, zirconia or the like are inserted into the openings 7*a* and 8*a*, respectively. Incidentally, the terminal plates 7, 8 themselves may be made from a hard ceramic such as alumina, zirconia or the like. In such a case, the terminal plates 7, 8 and the bearings 9, 10 may be integrally formed.

At both end surfaces of the valve body 2 are bored concave holes 2*a* and 2*b* and thereto are inserted valve axes 5 and 6 which are made from a hard ceramic such as alumina, zirconia or the like. The valve axes 5 and 6 are inserted to the bearings 9 and 10 and supported thereby, respectively.

in this embodiment, the cylinder-like portion 1' of the casing 1, terminal plates 7, 8, and bearings 9, 10 are bonded with an adhesive such as epoxy resins or the like. Also, the valve axes 5, 6 are inserted into the above mentioned concave holes 2*a*, 2*b* and bonded thereto with an adhesive.

The machinable ceramic impregnated with a resin has very high strength and toughness due to the resin contained therein. Thus, there is no generation of fractures or the like during processing. The machinable ceramic impregnated with a resin has a specific gravity of about 2~2.5 similar to the ceramics or slightly higher than that by the weight of the resin impregnated, and is light in weight. Thus, the rotary valves are light in weight. Incedentally, brass metal has a specific gravity of about 7.

As apparent from FIG. 1, the valve axes 5, 6 are a simple round bar, and the bearings 9, 10 have a simple cylindrical shape. Thus, these valve axes 5, 6 and bearings 9, 10 can be readily produced with high precision by means of a usual ceramic processing method, and the production cost is low. Incidentally, it is also possible in the present invention to use a hard anti-corrosive metal material such as stainless steel or the like instead of the hard ceramic.

Figure 3:
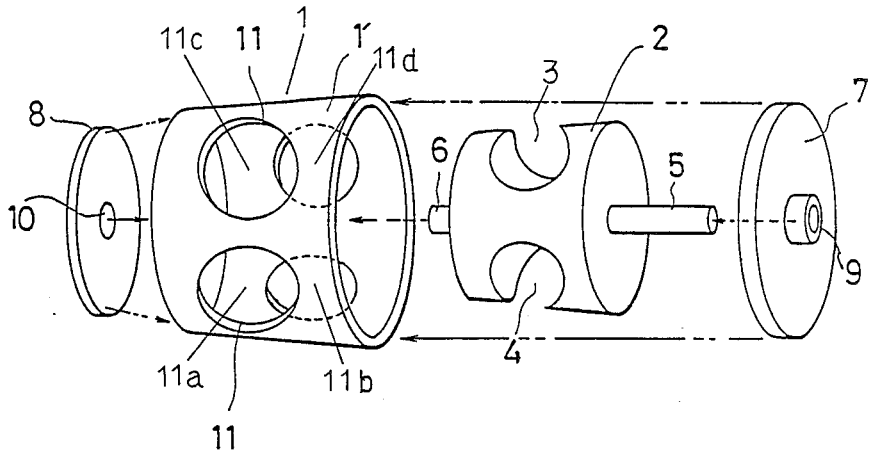
FIG. 3 shows a perspective decomposed view of a rotary valve.

Other numerals in FIG. 1 represent the same parts as shown in FIG. 3.

In the rotary valve having such constructions, the casing 1 including terminal plates 7, 8 and the valve body 2 can be readily produced with high precision by using the machinable ceramic-resin composite. The valve body 2 can rotate very lightly because of its light weight and good lubricating action, and is excellent in corrosion resistance. Moreover, since the valve axes 5, 6 and the bearings 9, 10 are made from the hard material, the wear resistance of the bearings is very high.

Figure 2:
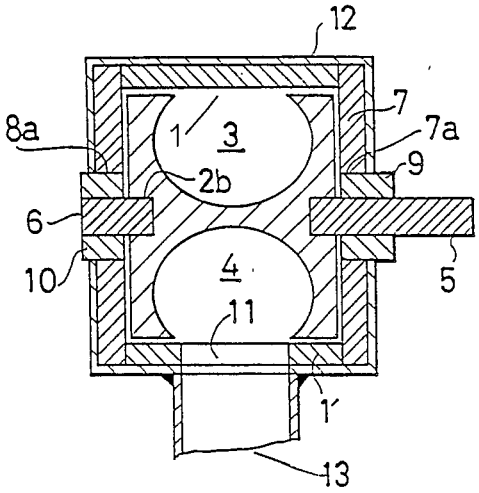

FIG. 2 is a longitudinal sectional view of a rotary valve according to another working example of the present invention. In this example, the casing 1 including terminal plates 7, 8 are substantially covered with a case 12 made of a metal material (e.g. brass). Since the metal case 12 can be connected to metal tubes 13 by means of brazing or soldering, ordinary craftsmen of the musical instruments can readily make or repair a brass wind instruments equipped with such rotary valves.

incidentally, the casing 1 can be produced from a metal material, although the casing is preferred to comprise the ceramic-resin composite material. When the casing is of a soft metal such as brass metal as conventionally employed, the inside surfaces of the casing can be plated with a harder metal such as nickel or chromium. In the case of the metal casing, the metal case 12 is not always needed.

The present invention is further explained below by way of working example and comparative examples.

EXAMPLE 1

One hundred (100) parts by weight of xonotlite and 10 parts by weight of talc (CaO: 44% by weight, $SiO_2$: 53% by weight, MgO: 3% by weight) were dry-blended in an Eirich mixer for 5 minutes, and then 16% (outer percentage) by weight of water was added thereto. The resulting mixture was allowed to stand under a sealed state for 24 hours to give a raw mixture material in which the water content thereof has been homogenized. The raw material was placed in molds for a valve body and a cylinder-like portion of the casing and therminal plates, and molded at 450 Kgf/cm$^2$. The molded articles were dried at 80° C. for 24 hours and then fired. The firing was carried out in an electric furnace by raising temperature therein from room temperature to 1250° C. at a rate of 10° C./min., firing the molded articles at 1250° C. for 60 minutes, and then allowing the articles to cool to room temperature in the furnace.

The resulting sintered article has a composition of $\beta$-wollastonite ($\beta CaO \bullet SiO_2$) in which Mg was dissolved. It had a water absorption capacity of 10.3% and was very excellent in cut-machinablility. It had a bending strength of 500 Kg/cm$^2$. The sintered ceramic article was placed in a vacuum apparatus and liquid PMMA was introduced with pressure to impregnate the ceramic article with the PMMA in the vacuum apparatus. The resin was hardened. The ceramic article thus impregnated with the resin had a water absorption capacity and air permeability of almost zero, which showed that the water absorption property and air permeability thereof had been eliminated.

The machinable ceramic-resin composite material thus obtained was lathed, bored by means of a superhard drill, and cut-machined to give the parts (i.e. the casing of about 2mm in thickness and the valve body) of the rotary valve shown in FIGS. 1 and 3. By assembling the parts and accessories and bonding necessary portions, a rotary valve as shown in FIG. 2 was produced.

The rotary valves thus produced were installed in a horn. The rotary valves rotated very lightly and the horn produced satisfactory sound tones.

EXAMPLE 2 (COMPARATIVE)

The rotary valve was produced from the machinable porous ceramic articles not impregnated with resin, as in Example 1 for comparison. The horn equipped with the resulting valves produced poor sound tones with some noises. The rotary valves rotated less smoothly.

EXAMPLE 3 (COMPARATIVE)

It was impossible to produce a feasible rotary valve from sintered alumina article having no continuous pores, because the sintered alumina was too hard and also suffered from fractures in the course of machining.

What is claimed is:

1. A rotary valve for a brass wind instrument which comprises a valve body rotatably contained in a casing therefor, characterized in that the valve body comprises a machinable ceramic-resin composite material and the casing comprises a machinable ceramic-resin composite material or a metal material, the machinable ceramic containing substantially continuous micropores and being impregnated with a resin material, the resin material being hardened, and the composite material being machine-processed.

2. The rotary valve according to claim 1, in which both the valve body and casing comprise the machinable ceramic-resin composite material.

3. The rotary valve according to claim 1, in which valve axes of a hard ceramic or anti-corrosive hard metal are connected to the valve body, and the valve axes are supported by the bearings of a hard ceramic or anti-corrosive hard metal attached to the casing.

4. The rotary valve according to claim 1, in which the outer surfaces of the casing are substantially covered with a metal case which is readily brazed or soldered.

5. The rotary valve according to claim 1, in which the machinable ceramic to be impregnated with a resin material has a water absorption capacity of 3 to 40%.

6. The rotary valve according to claim 1, in which the machinable ceramic is sintered at a maximum temperature of more than 1000° C. and comprises by weight 20~50 parts of CaO, 45~70 parts of $SiO_2$ and 0.1~25 parts of MgO.

7. The rotary valve according to claim 6, in which the machinable ceramic comprises by weight not less than 60% of the $CaO/SiO_2/MgO$ mineral components, not more than 20% of other alkali/alkaline-earth metal oxide components, and not more than 20% of other sintering mineral components.

8. The rotary valve according to claim 1, in which the resin material for the composite is selected from the group consisting of an acrylic resin, an epoxy resin, an unsaturated polyester resin, a saturated polyester resin, a silicone resin, and mixtures thereof.

9. The rotary valve according to claim 1, in which the rotary valve is for the use in a horn, tuba, trumpet, tenor bass, trombone, or bass trombone.

10. The rotary valve according to claim 2, in which valve axes of a hard ceramic or anti-corrosive hard metal are connected to the valve body, and the valve axes are supported by the bearings of a hard ceramic or anti-corrosive hard metal attached to the casing.

11. The rotary valve according to claim 2, in which the outer surfaces of the casing are substantially covered with a metal case which is readily brazed or soldered.

12. The rotary valve according to claim 2, in which the machinable ceramic to be impregnated with a resin material has a water absorption capacity of 3 to 40%.

13. The rotary valve according to claim 2, in which the machinabe ceramic is sintered at a maximum temperature of more than 1000° C. and comprises by weight 20~50 parts of CaO, 45~70 parts of $SiO_2$ and 0.1~25 parts of MgO.

14. The rotary valve according to claim 13, in which the machinable ceramic comprises by weight not less than 60% of the $CaO/SiO_2/MgO$ mineral components, not more than 20% of other alkali/alkaline-earth metal oxide components, and not more than 20% of other sintering mineral components.

15. The rotary valve according to claim 2, in which the resin material for the composite is selected from the group consisting of an acrylic resin, an epoxy resin, an unsaturated polyester resin, a saturated polyester resin, a silicone resin, and mixtures thereof.

16. A method for producing a rotary valve comprising a valve body and a casing for a brass wind instrument, the valve body of which comprises a machinable ceramic-resin composite material and the casing of which comprises the composite material or a metal material; which method comprises impregnating a machinable ceramic article containing substantially continuous micropores with a liquid resin material and hardening the resin material, machine-processing the resulting machinable ceramic-resin composite article into a shape of the valve body or shapes of the valve body and casing, and assembling the valve body into a rotary valve having the valve body rotatably contained in the casing.

17. The method according to claim 16, in which both the valve body and casing therefor are machine processed from the machinable ceramic-resin composite articles.

18. The method according to claim 16, in which the machinable ceramic to be impregnated with a resin material has a water absorption capacity of 3 to 40%.

19. The method according to claim 16, in which the machinable ceramic is sintered at a maximum temperature of more than 1000° C. and comprises by weight 20~50 parts of CaO, 45~70 parts of $SiO_2$ and 0.1~25 parts of MgO.

20. The method according to claim 17, in which the machinable ceramic to be impregnated with a resin material has a water absorption capacity of 3 to 40%.

* * * * *